US011024119B2

(12) United States Patent
Krastinš et al.

(10) Patent No.: US 11,024,119 B2
(45) Date of Patent: Jun. 1, 2021

(54) METHOD AND SYSTEM FOR CARD SHUFFLE INTEGRITY TRACKING

(71) Applicant: EVOLUTION MALTA LTD, Sllema (MT)

(72) Inventors: Janis Krastinš, IKskile (LV); Tania Johannisone-Melkvista, Sllema (MT); Snežana Lipovska, Riga (LV)

(73) Assignee: Evolution Malta Ltd

( * ) Notice: Subject to any disclaimer, the term of this patent is extended or adjusted under 35 U.S.C. 154(b) by 0 days.

(21) Appl. No.: 16/072,096

(22) PCT Filed: Jan. 25, 2017

(86) PCT No.: PCT/EP2017/051530
§ 371 (c)(1),
(2) Date: Jul. 23, 2018

(87) PCT Pub. No.: WO2017/129611
PCT Pub. Date: Aug. 3, 2017

(65) Prior Publication Data

US 2019/0035212 A1 Jan. 31, 2019

(30) Foreign Application Priority Data

Jan. 27, 2016 (SE) ..... 1650098-5

(51) Int. Cl.
*G07F 17/32* (2006.01)
*A63F 1/18* (2006.01)
*A63F 1/12* (2006.01)

(52) U.S. Cl.
CPC ..... *G07F 17/3241* (2013.01); *A63F 1/12* (2013.01); *A63F 1/18* (2013.01); *G07F 17/322* (2013.01);

(Continued)

(58) Field of Classification Search
CPC ..... G07F 17/3241; G07F 17/322; G07F 17/3234; G07F 17/3293
See application file for complete search history.

(56) References Cited

U.S. PATENT DOCUMENTS 5,702,106 A * 12/1997 Alvarez, Jr. ..... A63F 1/00 273/292
5,707,287 A * 1/1998 McCrea, Jr. ..... A63F 1/12 273/292

(Continued)

FOREIGN PATENT DOCUMENTS

CN 104 415 531 A 3/2015
EP 1646960 A2 4/2006

(Continued)

*Primary Examiner* — Tramar Harper
(74) *Attorney, Agent, or Firm* — Joseph T. Leone, Esq.; DeWitt LLP

(57) ABSTRACT

Method (300) and control unit (6) for monitoring shuffle quality of cards (4) during a card game. The method (300) comprises: identifying (301) each card (4) of a first round of cards; storing (302) a first sequence of the identified (301) cards (4) of the first round of cards, in the order they are discarded; identifying (303) each card (4) of a second round of cards (4), after shuffling but before being provided to one or more players; storing (304) a second sequence of the identified (303) cards (4) of the second round of cards, in the order they are provided to the one or more players; comparing (305) the stored (302) first sequence of cards (4) with the stored (304) second sequence of cards (4); detecting (306) a predetermined pattern in the second sequence of cards (4), originating from the first sequence of cards (4); and providing (307) an alert (8) when the predetermined pattern is detected (306) in the second sequence of cards (4).

11 Claims, 3 Drawing Sheets

(52) U.S. Cl.
CPC ..... *G07F 17/3234* (2013.01); *G07F 17/3293* (2013.01)

(56) References Cited

U.S. PATENT DOCUMENTS

| | | | | |
|---|---|---|---|---|
| 5,941,769 | A * | 8/1999 | Order | A63F 1/18 463/12 |
| 5,989,122 | A * | 11/1999 | Roblejo | A63F 1/14 273/149 P |
| 6,126,166 | A | 10/2000 | Lorson et al. | |
| 6,250,632 | B1 | 6/2001 | Albrecht | |
| 7,172,507 | B2 | 2/2007 | Fujimoto et al. | |
| 7,264,241 | B2 | 4/2007 | Schubert et al. | |
| 7,753,798 | B2 * | 7/2010 | Soltys | G07F 17/3293 273/149 P |
| 8,511,684 | B2 * | 8/2013 | Grauzer | A63F 1/14 273/149 P |
| 2002/0086727 | A1 * | 7/2002 | Soltys | G06K 7/084 463/22 |
| 2002/0165029 | A1 * | 11/2002 | Soltys | A63F 1/18 463/47 |
| 2003/0195025 | A1 * | 10/2003 | Hill | A63F 1/18 463/11 |
| 2005/0012269 | A1 * | 1/2005 | Grauzer | A63F 1/14 273/149 R |
| 2005/0137005 | A1 * | 6/2005 | Soltys | A63F 3/00157 463/13 |
| 2007/0004491 | A1 | 1/2007 | Gioia et al. | |
| 2007/0018389 | A1 * | 1/2007 | Downs, III | A63F 1/14 273/149 R |
| 2007/0077987 | A1 * | 4/2007 | Gururajan | G07F 17/32 463/22 |
| 2007/0287535 | A1 * | 12/2007 | Soltys | A63F 1/00 463/29 |
| 2009/0017888 | A1 * | 1/2009 | Kuhn | A63F 3/00157 463/13 |
| 2010/0038849 | A1 * | 2/2010 | Scheper | A63F 1/00 273/149 R |
| 2011/0130185 | A1 * | 6/2011 | Walker | A63F 1/14 463/13 |
| 2013/0292902 | A1 * | 11/2013 | Shigeta | A63F 1/10 273/148 R |
| 2015/0238848 | A1 | 8/2015 | Kuhn et al. | |
| 2015/0238849 | A1 * | 8/2015 | Shigeta | A63F 1/14 463/12 |
| 2015/0265908 | A1 * | 9/2015 | Shigeta | G07F 17/3241 273/149 R |
| 2015/0375095 | A1 * | 12/2015 | Shigeta | A63F 1/067 273/149 R |
| 2019/0111332 | A1 * | 4/2019 | Shigeta | A63F 9/24 |

FOREIGN PATENT DOCUMENTS

| | | |
|---|---|---|
| EP | 2 889 065 A1 | 4/2014 |
| WO | PCT/US2002/015885 | 12/2002 |
| WO | PCT/US2005/034732 | 4/2006 |
| WO | PCT/JP2013/004812 | 5/2014 |

* cited by examiner

| Table Name | SC | SS | MC | MS | A |
|---|---|---|---|---|---|
| Blackjack Live VIP (Malta) | | | | | |
| Blackjack NL 1 (Malta) | | | | | |
| Blackjack NL 2 (Malta) | | | | | |
| Blackjack Party | | | | | |
| Blackjack VIP A | | | | | |
| Blackjack VIP B | | | | | |
| Blackjack VIP C | | | | | |
| Blackjack VIP D | | | | | |
| Blackjack VIP E | | | | | |
| Blackjack VIP G | | | | | |

80
80
81
8
81

METHOD AND SYSTEM FOR CARD SHUFFLE INTEGRITY TRACKING

TECHNICAL FIELD

This document discloses a method and a control unit. More particularly, a method and a control unit are described, for monitoring shuffle quality of cards during a card game.

BACKGROUND

In any card game, it is important that the cards in the deck are randomized. Shuffling is a procedure used to randomize the deck of playing cards to provide an element of chance in card games.

Shuffling may be performed in various different ways. However, no shuffling method can guarantee a perfect randomization if insufficiently performed. On game tables where cards are shuffled on the table there is no known method to monitor if the shuffle procedure provides enough randomization of cards.

Once the deck (or decks as it may be, depending on game and choice of the game provider) is shuffled, it is set, and the order in which the cards are dealt cannot be changed. If the cards were not sufficiently randomized during the shuffling, the outcome of the dealt cards may be affected by the previous game of cards. A shuffling irregularity may be detected if a predetermined number of cards in a later-used set match the same predetermined number of cards in an earlier-used set in terms of suit and/or rank sequence, and/or deck number in case multiple decks are used. Thus, there is a need for a method to ensure the level of shuffle integrity after each shuffle procedure.

Document WO2014064872 A1 discloses a table game system for identifying shuffled playing cards used at the time of the occurrence of a problem in a card shoe apparatus, thereby enabling an investigation of the cause thereof or the taking of countermeasures therefor. The system comprises a barcode reader and an RFID that reads a barcode on the cards when taken from the card shoe. This information is then stored in a memory. Irregular shuffling may be determined if the order of a predetermined number of cards within a set matches at least a portion of the stored patterns.

The invention thus solves problems of a malfunctioning card shoe apparatus but does not provide a solution to the monitoring of shuffle randomness.

Document WO2006037009 A2 discloses a discard rack with card reader for playing cards. The disclosed solution comprises a rather complex and voluminous structure for receiving a deck of cards and verifying that they have been appropriately shuffled. The purpose of the known solution is to check if the deck of cards is complete (i.e. that no card has been lost), in between two rounds of play. In different embodiments, also other purposes are fulfilled by the provided known solution. However, the above stated problem is not addressed by the known card verification station.

Document WO02101630 A1 discloses a solution for verifying card games, such as playing cards distribution. One or more actual hands of playing cards are verified against respective expected hands of playing cards, to determine whether the playing cards actually dealt correspond to the playing cards that should have been dealt based on a starting sequence of playing card values. The starting sequence of playing card values can be determined by reading identifiers from a number of playing cards prior to dealing. Again, the problem of detecting insufficient shuffling is not addressed by the disclosed solution.

Document U.S. Pat. No. 5,989,122 A concerns an apparatus and process for verifying, sorting, and randomizing sets of playing cards and process for playing card games. The complex and voluminous apparatus shuffles a deck of cards. The solution thereby solves the problem of shuffling a deck of cards by an apparatus, rather than checking if a deck of humanly shuffled cards has been appropriately shuffled.

Document U.S. Pat. No. 6,126,166 A discloses an integrated blackjack game control system having multiple sensors and output devices, electronic signal processing equipment, passive and active operator control devices, and a computer system. The system components are capable of being installed on or near existing blackjack tables and support equipment, and to operate with standard playing cards. The system performs several simultaneous functions to accelerate the play of a game of blackjack, enhance the shuffling process, and perform continuous monitoring of key dealer and table performance attributes.

The provided known solution is dedicated to limit a casino's vulnerability to so called card counters and shuffle trackers and does not concern shuffle monitoring. Further, the provided solution only concerns Black Jack, other card games are not addressed.

Document EP1646960 A2 presents a method and apparatus determines an identity of each card in a card hand at a casino table card game. The method is performed automatically by a computer based system that reads the rank and suit of each card that leaves a dealing shoe and then uses a smart discard tray that reads the discards as they are taken from the table.

The above stated problem is not addressed in this document.

Document U.S. Pat. No. 7,264,241 B2 presents a method of controlling the game of baccarat. The method including the steps of providing a card delivery shoe equipped with a sensor capable of reading at least a rank of each card a first processor capable of controlling operation of the card delivery shoe and a second processor capable of receiving signals from the sensor and programmed to display information related to the game of baccarat.

However, the issue of controlling if the shuffling has been made correctly is not addressed in this document.

Document EP2889065A1 relates to a table game system capable of preventing fraud. A sequence of cards that are dealt from a shoe is compared with a set of predetermined cases such as e.g. cards in an increasing value sequence (for a predetermined number of cards), cards with the same rank for a predetermined number of cards, etc. Thereby, a fraudulent behaviour by the croupier and similar may be detected.

However, no solution is provided to the problem of determining whether the cards are insufficiently shuffled. Document U.S. Pat. No. 7,172,507B2 discloses a card game monitoring method. The method aims at preventing cards from being lost or replaced during games played using a large number of cards.

The document does not concern detection of card shuffling integrity at all, but rather aims at preventing fraudulent behaviour.

As these described scenarios, and similar variants of them, may lead to increased risk of non-randomized cards in the deck, it is desirable to find a solution.

SUMMARY

It is therefore an object of this invention to solve at least some of the above problems and provide a solution of monitoring if the shuffle procedure provides enough randomization of cards by comparing the outgoing cards from a shoe to the discarded cards, and detecting patterns in the card stacks.

According to a first aspect of the invention, this objective is achieved by a method in a control unit, for monitoring shuffle quality of cards during a card game. The method comprises identifying each card of a first round of cards, when being discarded. Further the method comprises storing a first sequence of the identified cards of the first round of cards, in the order they are discarded. The method also comprises identifying each card of a second round of cards, after shuffling but before being provided to one or more players of the game. In addition, the method also comprises storing a second sequence of the identified cards of the second round of cards, in the order they are provided to the one or more players and/or dealer. The method also comprises comparing the stored first sequence of cards with the stored second sequence of cards. Additionally, the method furthermore comprises detecting a predetermined pattern in the second sequence of cards, originating from the first sequence of cards. The method further comprises providing an alert when the predetermined pattern is detected in the second sequence of cards.

According to a second aspect of the invention, this objective is achieved by a control unit for monitoring shuffle quality of cards during a card game. The control unit is configured to identify each card of a first round of cards, when being discarded. Further the control unit is configured to store a first sequence of the identified cards of the first round of cards, in the order they are discarded, in a memory. The control unit is in addition configured to identify each card of a second round of cards after shuffling but before being provided to one or more players, via a second sensor. Additionally, the control unit is configured to store a second sequence of the identified cards of the second round of cards, in the order they are provided to the one or more players, in the memory. Furthermore, the control unit is also configured to compare the stored first sequence of cards with the stored second sequence of cards. Also, the control unit is further configured to detect a predetermined pattern in the second sequence of cards, originating from the first sequence of cards. The control unit is also configured to provide an alert when the predetermined pattern is detected in the second sequence of cards, via an output unit.

Thanks to the described aspects, shuffling may be surveyed and insufficient shuffling may be detected by the comparison of discarded cards and later distributed cards dealt to the players. Thus, a randomness of the provided cards when playing is provided, which gives the players as well as the casino house a guarantee that no other player may take advantage of insufficient shuffling. Thereby randomness of the cards is continuously provided.

Other advantages and additional novel features will become apparent from the subsequent detailed description.

FIGURES

Embodiments of the invention will now be described in further detail with reference to the accompanying figures, in which.

DETAILED DESCRIPTION

Embodiments of the invention described herein are defined as a method and a control unit, which may be put into practice in the embodiments described below. These embodiments may, however, be exemplified and realised in many different forms and are not to be limited to the examples set forth herein; rather, these illustrative examples of embodiments are provided so that this disclosure will be thorough and complete.

Still other objects and features may become apparent from the following detailed description, considered in conjunction with the accompanying drawings. It is to be understood, however, that the drawings are designed solely for purposes of illustration and not as a definition of the limits of the herein disclosed embodiments, for which reference is to be made to the appended claims. Further, the drawings are not necessarily drawn to scale and, unless otherwise indicated, they are merely intended to conceptually illustrate the structures and procedures described herein.

Figure 1:
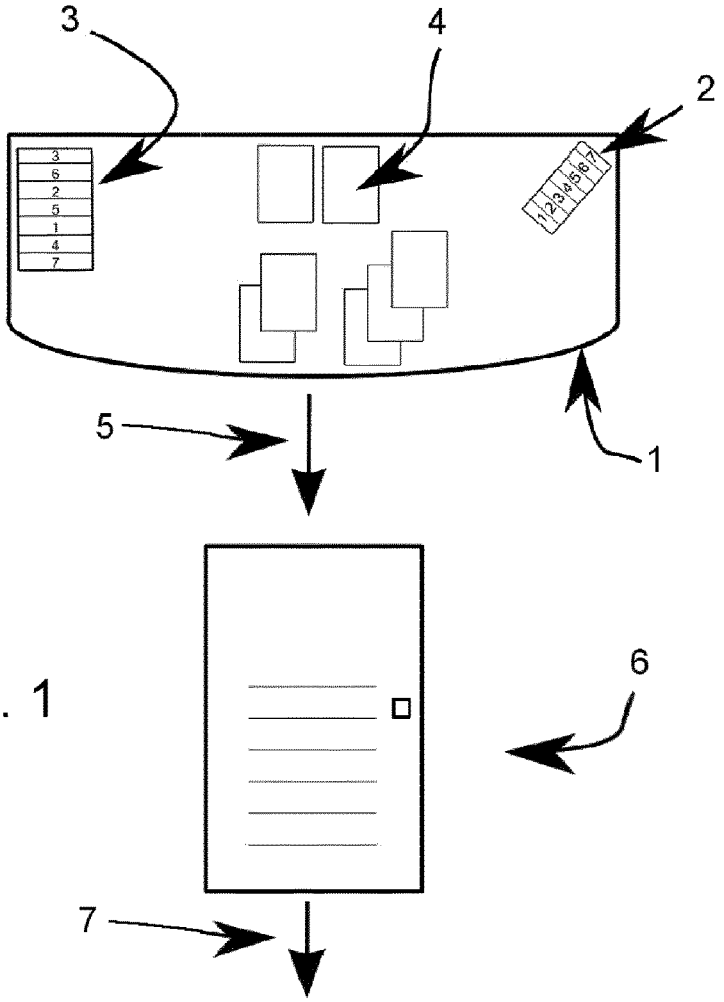
FIG. 1 illustrates a schematic overview of an embodiment of the invention.

FIG. 1 illustrates a scenario with a game table 1, for playing card games. Sometimes when a new game of cards commences, at least one deck of cards 4 is shuffled. In the illustrated embodiment, the cards 4 are placed in a card shoe 2 afore they are distributed to players at the table 1. In some games like e.g. Black Jack and some Poker games, also the dealer receives cards 4. As previously mentioned, a plurality of decks may be used in some games. Sometimes, in particular when a plurality of decks is used, it may not be required to shuffle the deck/decks between each game; e.g. when playing Black Jack or Baccarat games, four decks may be dealt out from an eight deck shoe 2 before the next shuffle.

A card shoe 2, or dealing shoe (dealer's shoe) as it also may be referred to as, is a gaming device, mainly used in casinos, to hold one or more decks of playing cards 4. The card shoe 2 allows for more games to be played by reducing the time between shuffles and less chance of dealer cheating. In some games, such as Blackjack (where card counting is a possibility), using multiple decks of cards 4 can increase the house edge.

Every card 4 dealt out of the card shoe 2 is uniquely identified by value, suite and deck. The means of identification may comprise e.g. bar-code scanning of the cards 4, based on visible, infrared, or ultraviolet light; or alternatively card image/video recognition using computer vision software. Radio-Frequency Identification (RFID) is another possibility of uniquely identifying the cards 4. The sequence of cards 4 coming out of the shoe 2 is tracked from the moment the shoe 2 is placed on the table 1 until the next shuffle procedure or until the shoe 2 is replaced by a second shoe.

The cards 4 are laid out on the game table in specific manner that is particular for each game. Any kind of card game may be played at the table 1, such as e.g. Poker in various variants such as 5-card draw, 5-card stud, Texas Hold'em, Omaha Hold'em, Razz, Pineapple, and 7-card stud, Caribbean stud poker, three card poker; Blackjack; Baccarat. The enumerated games are merely some arbitrary examples.

As the cards 4 coming out of the shoe 2 are known it is possible to definitively determine where each of the cards 4 is on the game table 1. At the end of the game the dealer collects the cards 4 in a predefined manner specific to each game and puts the cards 4 of one game in the card discard holder 3. Thus, the card sequence in the discard holder 3 can be accurately determined by identifying each card 4 as it is discarded. The cards 4 that are held by each player (and the dealer in some games) are known, as they have been identified during distribution to the players. As also the card collection procedure is known and predetermined to be consistent, the identity of the discarded cards could be reconstructed. Another option in some alternative embodiments may be to use a sensor for identifying the discarded cards 4, as will be further discussed when presenting FIG. 2. The results of the identification of cards 4 at the card shoe 2 and the discard holder 3 is transmitted via a wired or wireless communication interface 5 to a control unit 6.

Such communication interface 5 may comprise; be based on, or at least be inspired by wireless communication technology such as Wi-Fi, Wireless Local Area Network (WLAN), Ultra Mobile Broadband (UMB), Bluetooth (BT), or infrared transmission to name but a few possible examples of wireless communications.

The control unit 6 may comprise a computer, server or similar device. The control unit 6, upon receiving identification references of cards 4 as they are discarded at the discard holder 3, establish a first sequence of the identified cards 4, and a second sequence of the identified cards 4 as they are dealt from the card shoe 2 in the order they are provided to the one or more players. These established first and second sequences are then stored in a memory, or database.

After every card, game or shuffle in different embodiments, the cards 4 of the outgoing sequence from the card shoe 2 is compared with a previous discard sequence of the discard holder 3. In case the table 1 has two card shoes 2 then outgoing cards 4 may be compared with the discard sequence of this particular shoe 2. The comparison aims at detecting a pattern indicating insufficient shuffling.

Such pattern may comprise, in some non-limiting examples, a clump; i.e. an occurrence of any configurable number (or more) of known cards 4 in the same sequence as they previously have been put in the discard holder 3. Another example of the pattern may be a clump comprising an occurrence of any configurable number (or more) of known cards 4 in the second sequence of cards 4 without any random card 4 in between.

A sequence as used herein may be defined as an occurrence of X (configurable) or more known cards 4 in sequence with zero to Y (configurable) random cards 4 between them.

The results of the comparison, i.e. number and size of matches found, may be transmitted over a wired or wireless communication interface 7, to be received and displayed on an output unit 8 that may show shuffle quality of all casino card tables. In case of bad shuffle, a Risk Analyst, manager or similar individual may be alerted and thereby becomes enabled to take measures to ensure proper shuffle in the future. The output unit 8 may comprise a display, a loudspeaker, a tactile device or a combination thereof in different embodiments.

Such result may be indicated e.g. by colour indications such as green, yellow, red etc., for indicating sufficient shuffling, doubtful shuffling and insufficient shuffling, respectively, i.e. a first colour 80 indicating a sufficient shuffling and a second colour 81 indicating doubtful or insufficient shuffling. In some embodiments, a number rating may indicate e.g. number of unshuffled cards 4 in a row or another indication of the severity of the insufficient shuffling. Further, in some embodiments, the provided report may be alternatively provided or completed by means of an alerting signal via a loudspeaker, and/or a haptic signal.

Further, in some embodiments the presented method for monitoring shuffle quality, also allows to identify advantage players by tracking players that bet increasingly when a clump or sequence of known cards 4 is dealt on the table 1. This may be made by identifying the players at the table 1, survey the betting pattern of each respective betting pattern of the respective identified players and notifying an increasing betting pattern at a moment when insufficient shuffling quality is detected.

Figure 2:
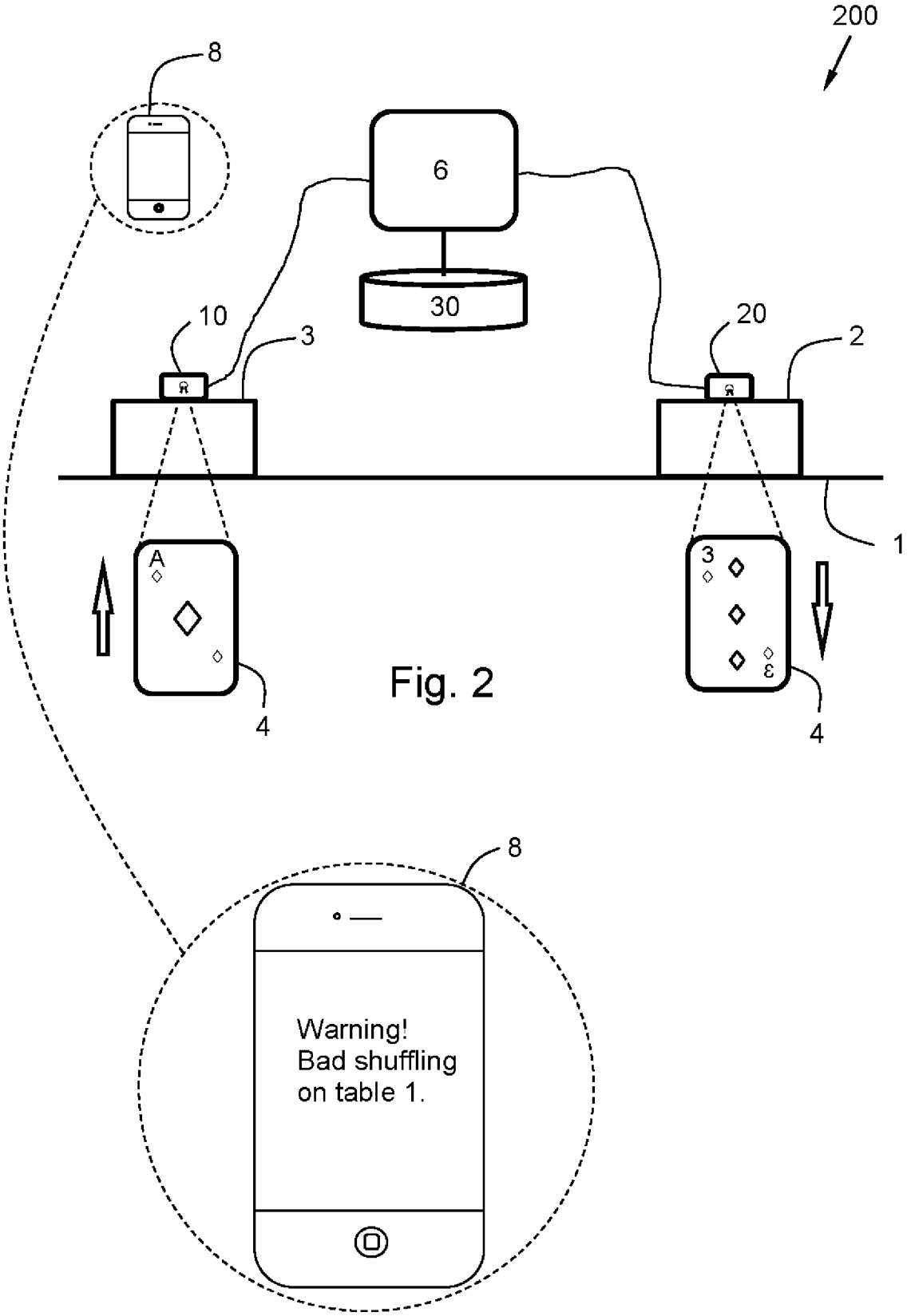
FIG. 2 illustrates yet an embodiment of the invention.

FIG. 2 presents a system 200 for monitoring shuffle quality of a deck of cards 4 during a card game.

An example of how the system 200 may be applied will be presented and discussed. Firstly, during a first round of gaming, all discarded cards 4 at the discard holder 3 are identified, either by reconstructing the card sequence based on knowledge of the cards 4 that have been dealt to each of the players (and dealer in some games), and by knowing the card collection procedure, which is consistent for each game; or, in some optional embodiments, by a first sensor 10. The sensor 10 may recognise the cards 4 based on image recognition, bar code scanning, RFID, and/or similar means for recognition. As the cards 4 are detected and identified, e.g. by the sensor 10, a respective identification reference is transmitted to the control unit 6, which may comprise a computer, server or similar device in some embodiments.

At the control unit 6 is then a first sequence of the identified cards 4 composed, in the order they are discarded. This first sequence is then stored in a memory/database 30.

The game is then performed, until a cutting card in the card shoe 2 is reached. When the cutting card is taken out of the card shoe 2, the current game is finished and the shuffle procedure is performed, or alternatively the card shoe 2 is changed. The dealer then collects the cards 4 from the discard holder 3, shuffle them and place them in the card shoe 2.

As the dealer then starts distributing cards 4 from the shoe 2 to the players, each distributed card 4 is identified by a second sensor 20. The sensor 20 may be of the same, or similar type as the previously described optional first sensor 10 at the discard holder 3, and may recognise the cards 4 based on image recognition, bar code scanning, RFID, and/or similar means for recognition.

As the cards 4 are detected and identified by the sensor 20 when they are distributed, a respective identification reference is transmitted to the control unit 6, which may comprise a computer, server or similar device.

At the control unit 6 is then a second sequence of the identified cards 4 composed, in the order they are distributed. This second sequence is then stored in the memory/database 30.

The second sequence of stored cards is then compared with the stored first sequence at the control unit 6. The aim of the comparison is to detect any predetermined pattern in the second sequence of cards 4, originating from the first sequence of cards 4. Such predetermined pattern may comprise e.g. a subsequence of cards 4, exceeding a predetermined and/or configurable threshold value, which are placed in the same order in the second sequence as they are in the first sequence. The threshold value may comprise any positive integer exceeding 1 while being smaller than the number of cards 4 in the stored first sequence of cards.

However, the predetermined pattern may in some embodiments be defined as a subsequence of cards 4, exceeding a configurable second threshold limit, in the same sequential order as stored in the first sequence of cards 4, without any random card 4 in between.

In some embodiments, the predetermined pattern in the second sequence of cards 4 may comprise a number of cards 4, exceeding a configurable third threshold limit, in the same sequential order as stored in the first sequence of cards 4, with an in between number of random cards 4, lower than a fourth threshold limit.

In case the control unit 6 detects any predetermined pattern in the second sequence of cards 4 according to the above definitions, an alert may be provided. The alert may be provided over a wired or wireless communication interface 7 to an output unit 8, e.g. a display. The alert may comprise an identification reference to the table 1 in some embodiments. Further, the alert may comprise additional information such as e.g. length and/or amount of recognised predetermined patterns.

The control unit 6 may comprise a processor, configured for performing computations for making the comparison between the first and the second stored sequences. Such processor may comprise one or more instances of a processing circuit, i.e. a Central Processing Unit (CPU), a processing unit, a processing circuit, a processor, an Application Specific Integrated Circuit (ASIC), a microprocessor, or other processing logic that may interpret and execute instructions. The herein utilised expression "processor" may thus represent a processing circuitry comprising a plurality of processing circuits, such as, e.g., any, some or all of the ones enumerated above.

The memory 30 may comprise a tangible, physical device utilised to store data or programs, i.e., sequences of instructions, on a temporary or permanent basis. According to some embodiments, the memory 30 may comprise integrated circuits comprising siliconbased transistors. The memory 30 may comprise e.g. a memory card, a flash memory, a USB memory, a hard disc, or another similar volatile or non-volatile storage unit for storing data such as e.g. ROM (Read-Only Memory), PROM (Programmable Read-Only Memory), EPROM (Erasable PROM), EEPROM (Electrically Erasable PROM), etc., in different embodiments.

Figure 3:
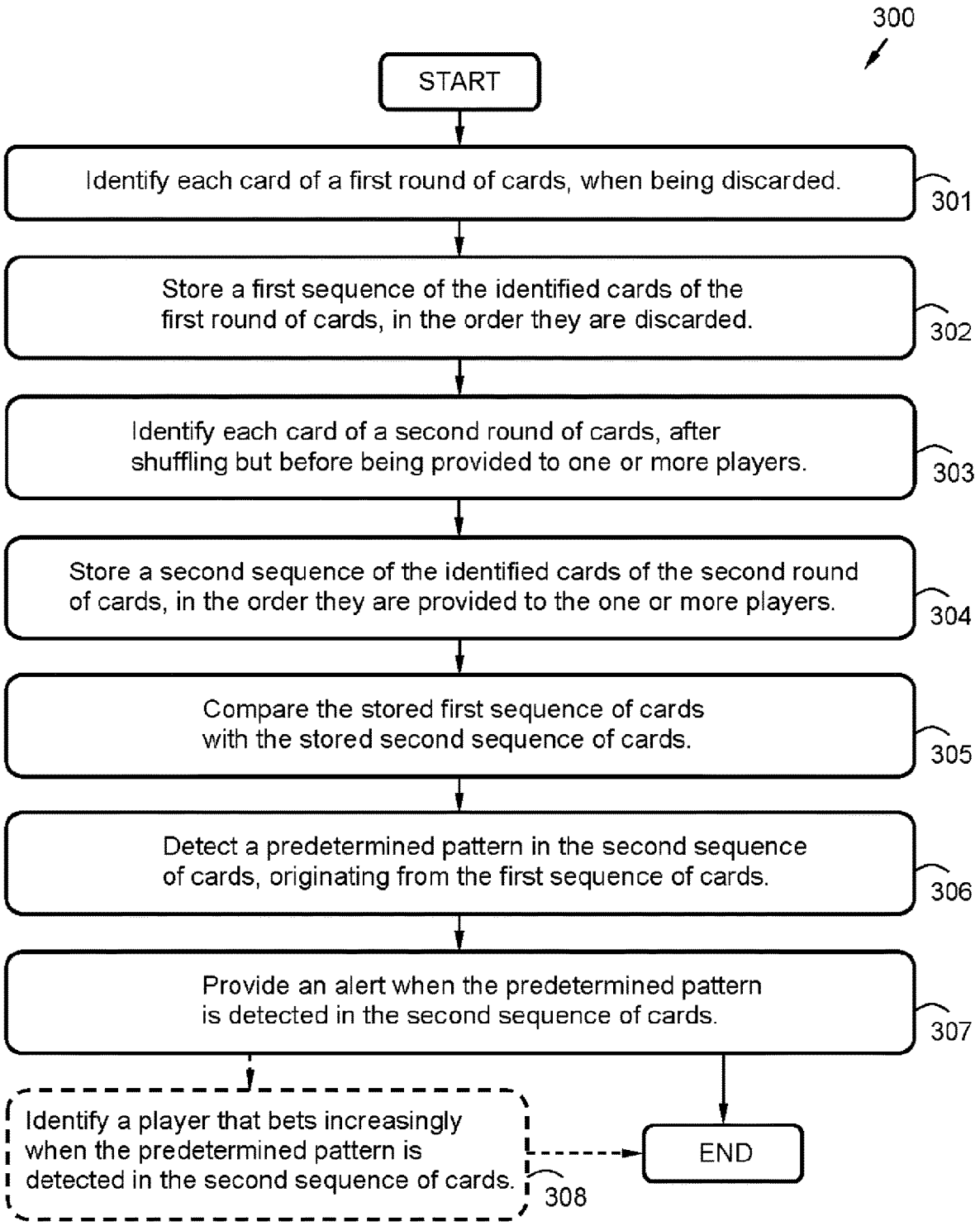
FIG. 3 is a flow chart illustrating an embodiment of the method.

FIG. 3 is a flow chart illustrating an example of a method 300 for monitoring shuffle quality of cards 4 during a card game.

The method 300 may be performed e.g. in a casino environment comprising a plurality of gaming tables 1, in some embodiments. The method 300 comprises comparing a first sequence of discarded cards 4 of a first round of play, with a second sequence of discarded cards 4 of a second round of play and discover a subsequence of the first sequence in the second sequence, wherein shuffling has been made in between the two rounds of play. The method 300 may be performed in a control unit 6. In some embodiments, the method 300 may be computer implemented.

In some embodiments, when the method 300 is performed for the first time, the first sequence may be set to a pre-set order of cards in a new pack of cards, or a plurality of new packs of cards. The first sequence may alternatively be ignored in some embodiments.

Some embodiments may comprise comparing the dealt cards from a second shoe 2 to a pre-set order of cards when the card shoe 2 is changed during the card change procedure or when the shoe 2 is changed on a multi-shoe table in the first round of dealing.

In order to be able to correctly monitoring shuffle quality of the cards 4, the method 300 may comprise a number of steps 301-308. However, some of these steps 301-308 may be performed solely in some alternative embodiments, like e.g. step 308. Further, the described steps 301-308 may be performed in a somewhat different chronological order than the numbering suggests. The method 300 may comprise the subsequent steps:

Step 301 comprises identifying each card 4 of a first round of cards, when being discarded.

The identification of the discarded cards 4 may in some embodiments comprise determining the cards 4 held by each player (and the dealer in some games) participating, and by knowing the card collection procedure, which is consistent for each game.

When cards 4 are distributed to the players from the card shoe 2, a sensor arranged at the card shoe 2 detects and identifies each card 4 by value, suite and deck (in case several decks are used). This information may be stored, associated with each respective player of the game in a memory. The cards 4 of the players are discarded in a consistent manner for each game. Thereby each of the discarded cards may be identified and an array of discarded cards may be established.

The cards 4 discarded at the discard holder 3 may in some alternative embodiments be identified by a first sensor 10, configured to detect, recognise and identify cards 4. Each card 4 may be identified by value, suite and deck, in some embodiments.

Step 302 comprises storing a first sequence of the identified 301 cards 4 of the first round of cards, in the order they are discarded. The first sequence of the identified 301 cards 4 may be stored in a memory/database 6.

Step 303 comprises identifying each card 4 of a second round of cards 4, after shuffling but before being provided to one or more players. The cards 4 may be kept in a card shoe 2 and may be identified by a second sensor 20, configured to detect, recognise and identify cards 4. Each card 4 may be identified by value, suite and deck, in some embodiments.

The card shoe 2 may contain a plurality of decks of cards and the second round of cards may start when the card shoe 2 is loaded with shuffled cards 4 and may last until a cutting card in the card shoe 2 is reached, or until the card shoe 2 is empty, or almost empty, i.e. contains too few cards 4 for continue playing.

Step 304 comprises storing a second sequence of the identified 303 cards 4 of the second round of cards, in the order they are provided to the one or more players. The second sequence of the identified 303 cards 4 may be stored in the memory/database 30.

Step 305 comprises comparing the stored 302 first sequence of cards 4 with the stored 304 second sequence of cards 4.

Step 306 comprises detecting a predetermined pattern in the second sequence of cards 4, originating from the first sequence of cards 4.

The predetermined pattern in the second sequence of cards 4 may comprise e.g. a number of cards 4, exceeding a configurable first threshold limit, in the same sequential order as stored 302 in the first sequence of cards 4, in some embodiments.

In some embodiments, the predetermined pattern in the second sequence of cards 4 may comprise a number of cards 4, exceeding a configurable second threshold limit, in the same sequential order as stored 302 in the first sequence of cards 4, without any random card 4 in between.

Further, according to some embodiments, the predetermined pattern in the second sequence of cards 4 may comprise a number of cards 4, exceeding a configurable third threshold limit, in the same sequential order as stored 302 in the first sequence of cards 4, with an in between number of random cards 4, lower than a fourth threshold limit.

Step 307 comprises providing an alert when the predetermined pattern is detected 306 in the second sequence of cards 4.

The provided alert may comprise a report of number and size of detected 306 predetermined patterns in some embodiments.

The alert may be provided on a display 8, e.g. by a word message, a colour indication, an audit signal, a spoken message, a haptic signal etc.

Detected patterns may be analysed manually e.g. by a Risk Analyst, supervisor or other person responsible for the gaming activity, or someone contracted for this purpose, by viewing the discard holder 3 and the card shoe 2 and visually identify patterns, in some embodiments.

Step 308, which only may be performed in some embodiments, comprises identifying a player that bets increasingly when the predetermined pattern is detected 306 in the second sequence of cards 4.

The identification of such player may be made by continuously or at intermittent intervals surveying betting pattern of the respective players at the table 1. Further, in case the betting of a player increases over a threshold percent when the predetermined pattern in the second sequence of cards 4 is detected 306, the particular player may be identified.

The previously described steps 301-308 to be performed by the system 200 for monitoring shuffle quality of cards 4, together with computer program product for performing at least some of the functions of the steps 301-308. Thus a computer program product, comprising instructions for performing the steps 301-308 in the control unit 6 may perform the method 300 comprising at least some of the steps 301-308 for monitoring shuffle quality of cards 4 during the card game when the computer program is loaded into the one or more processors of the control unit 6.

The computer program product mentioned above may be provided for instance in the form of a tangible data carrier carrying computer program code for performing at least some of the step 301-308 according to some embodiments when being loaded into the one or more processors of the control unit 6. The data carrier may be, e.g., a hard disk, a CD ROM disc, a memory stick, an optical storage device, a magnetic storage device or any other appropriate medium such as a disk or tape that may hold machine readable data in a non-transitory manner. The computer program product may furthermore be provided as computer program code on a server and downloaded to the control unit 6 remotely, e.g., over an Internet or an intranet connection.

The terminology used in the description of the embodiments as illustrated in the accompanying drawings is not intended to be limiting of the described method 300; the system 200, the computer program and/or the control unit 6. Various changes, substitutions or alterations may be made, without departing from invention embodiments as defined by the appended claims.

As used herein, the term "and/or" comprises any and all combinations of one or more of the associated listed items. The term "or" as used herein, is to be interpreted as a mathematical OR, i.e., as an inclusive disjunction; not as a mathematical exclusive OR (XOR), unless expressly stated otherwise. In addition, the singular forms "a", "an" and "the" are to be interpreted as "at least one", thus also possibly comprising a plurality of entities of the same kind, unless expressly stated otherwise. It will be further understood that the terms "includes", "comprises", "including" or "comprising", specifies the presence of stated features, actions, integers, steps, operations, elements, or components, but do not preclude the presence or addition of one or more other features, actions, integers, steps, operations, elements, components, or groups thereof. A single unit such as e.g. a processor may fulfil the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solidstate medium supplied together with or as part of other hardware, but may also be distributed in other forms such as via Internet or other wired or wireless communication system.

The invention is not limited by the examples described above but may be varied within the scope of the appended claims, e.g. it is evident for the skilled person that the inventive concept may also be used for being able to compare the dealt cards from a card shoe to a pre-set order of cards when a card shoe is changed during the card change procedure or when a card shoe is changed on a multi-shoe (usually two) table in the first round of dealing.

The invention claimed is:

1. A method (300) implemented by a control unit (6) for monitoring shuffle quality of at least one deck of cards (4) in a card shoe during a card game, which method (300) comprises:

identifying (301) each card (4) of a first round of cards of the card game via a first sensor, when being discarded;

storing (302) a first sequence of the identified (301) cards (4) of the first round of cards, in the order they are discarded;

identifying (303) each card (4) of a second round of cards (4) of the card game, after shuffling of the first round of cards or after replacing the card shoe but before being provided to one or more players, via a second sensor;

storing (304) a second sequence of the identified (303) cards (4) of the second round of cards, in the order they are provided to the one or more players;

comparing (305) the stored (302) first sequence of cards (4) with the stored (304) second sequence of cards (4);

detecting (306) a predetermined pattern in the second sequence of cards (4), originating from the first sequence of cards (4); and providing (307) an alert (8) to a dealer of the card game when the predetermined pattern is detected (306) in the second sequence of cards (4), the alert including a number and size of the detected (306) predetermined pattern.

2. The method (300) according to claim 1, further comprising:

identifying (308) a player that bets increasingly when the predetermined pattern is detected (306) in the second sequence of cards (4).

3. The method (300) according to any of claim 1 or claim 2, wherein the predetermined pattern in the second sequence of cards (4) comprises a number of cards (4), exceeding a configurable first threshold limit, in the same sequential order as stored (302) in the first sequence of cards (4).

4. The method (300) according to claim 1, wherein the predetermined pattern in the second sequence of cards (4) comprises a number of cards (4), exceeding a configurable second threshold limit, in the same sequential order as stored (302) in the first sequence of cards (4), without any random card in between.

5. The method (300) according to claim 1, wherein the predetermined pattern in the second sequence of cards (4) comprises a number of cards (4), exceeding a configurable third threshold limit, in the same sequential order as stored (302) in the first sequence of cards (4), with an in-between number of random cards, lower than a fourth threshold limit.

6. The method (300) according to claim 1, wherein the predetermined pattern in the second sequence of cards (4) is different from the first sequence of cards (4), but all the identified cards 4 are together without any random cards in-between.

7. The method (300) according to claim 1, wherein the predetermined pattern in the second sequence of cards (4) is different from the first sequence of cards (4), but there are random cards in-between.

8. The method (300) according to claim 1, wherein the provided (307) alert comprises a report of number and size of detected (306) predetermined patterns.

9. A control unit (6) for monitoring shuffle quality of at least one deck of cards (4) in a card shoe during a card game, wherein the control unit (6) comprises:

one or more processors, wherein the one or more processors are configured to:

identify each card (4) of a first round of cards of the card game via a first sensor, when being discarded;

store a first sequence of the identified cards (4) of the first round of cards, in the order they are discarded, in a memory (30);

identify each card (4) of a second round of cards (4) of the card game, after shuffling of the first round of cards or after replacing the card shoe but before being provided to one or more players, via a second sensor (20);

store a second sequence of the identified cards (4) of the second round of cards, in the order they are provided to the one or more players, in the memory (30);

compare the stored first sequence of cards (4) with the stored second sequence of cards (4);

detect a predetermined pattern in the second sequence of cards (4), originating from the first sequence of cards (4); and provide an alert to a dealer of the card game when the predetermined pattern is detected in the second sequence of cards (4), via an output unit (8), the alert including a number and size of the detected (306) predetermined pattern.

10. The control unit (6) of claim 9, wherein the one or more processors are further configured to identify a player that bets increasingly when the predetermined pattern is detected in the second sequence of cards (4).

11. A non-transitory computer-readable medium storing a computer program including program code executable thereon, which, when executed by a processor, cause the processor to perform the method comprising:

identifying (301) each card (4) of a first round of cards of a card game via a first sensor, when being discarded;

storing (302) a first sequence of the identified (301) cards (4) of the first round of cards, in the order they are discarded;

identifying (303) each card (4) of a second round of cards (4) of the card game via a second sensor, after shuffling of the first round of cards or after replacing a card shoe in which the cards are located but before being provided to one or more players;

storing (304) a second sequence of the identified (303) cards (4) of the second round of cards, in the order they are provided to the one or more players;

comparing (305) the stored (302) first sequence of cards (4) with the stored (304) second sequence of cards (4);

detecting (306) a predetermined pattern in the second sequence of cards (4), originating from the first sequence of cards (4); and providing (307) an alert (8) to a dealer of the card game when the predetermined pattern is detected (306) in the second sequence of cards (4), the alert including a number and size of the detected (306) predetermined pattern.

* * * * *